US006362412B1

(12) United States Patent
Ura

(10) Patent No.: US 6,362,412 B1
(45) Date of Patent: Mar. 26, 2002

(54) ANALYZER USED FOR PLURAL PHYSICAL QUANTITIED, METHOD USED THEREIN AND MUSICAL INSTRUMENT EQUIPPED WITH THE ANALYZER

(75) Inventor: Tomoyuki Ura, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/492,573

(22) Filed: Jan. 27, 2000

(30) Foreign Application Priority Data

Jan. 29, 1999 (JP) ..... 11-022548

(51) Int. Cl.[7] ..... G10P 3/00; G10H 5/00
(52) U.S. Cl. ..... 84/658; 84/744; 73/488
(58) Field of Search ..... 84/20, 21, 658, 84/743, 744; 73/488

(56) References Cited

U.S. PATENT DOCUMENTS 5,922,983 A * 7/1999 Muramatsu
5,977,466 A * 11/1999 Muramatsu ..... 84/743 X
6,121,535 A * 9/2000 Muramatsu ..... 84/658 X

FOREIGN PATENT DOCUMENTS

JP 54-43715 12/1979

* cited by examiner

*Primary Examiner*—Jeffrey Donels
(74) *Attorney, Agent, or Firm*—Morrison & Foerster LLP

(57) ABSTRACT

An electronic piano has only one set of analog key sensors/shutter plates under the keyboard, and an electronic sound generating system processes pieces of data information from the analog key sensors through different computer programs for an initial-touch and an after-touch so as to achieve a wide variety of sound control without increase of electric components.

7 Claims, 6 Drawing Sheets

ANALYZER USED FOR PLURAL PHYSICAL QUANTITIED, METHOD USED THEREIN AND MUSICAL INSTRUMENT EQUIPPED WITH THE ANALYZER

FIELD OF THE INVENTION

This invention relates to an analyzer available for plural physical quantities and, more particularly, to an analyzer available for plural physical quantities varied by operating a manipulator such as, for example, a key manipulated during a performance, a method used therein and a musical instrument equipped with the analyzer.

DESCRIPTION OF THE RELATED ART

It has been proposed to control the volume of sounds and effects on the basis of the motions of manipulators such as keys incorporated in an electronic keyboard musical instrument. This control technique is called as "touch response". An initial touch control is a kind of the touch response. The downward key velocity is detected so as to control the sound through the initial touch control. Another kind of touch response is an after touch control, in which the sound is controlled on the basis of the key motion after being depressed. Thus, the initial touch control requires the detection of the key velocity, and variation of the force exerted on the depressed key is detected for the after touch control. Accordingly, the prior art electronic keyboard musical instrument is equipped with key velocity sensors for the initial touch control and pressure sensors for the after touch control.

The electronic keyboard musical instrument usually has eighty-eight keys, and eighty-eight key velocity sensors and eighty-eight pressure sensors are required for the touch response. However, the eighty-eight key velocity sensors and the eighty-eight pressure sensors occupy wide space inside the prior art electronic keyboard musical instrument, and are costly. This is the first problem inherent in the electronic keyboard musical instrument.

As known to a person skilled in the art, an acoustic piano gives the unique key-touch to players. User may want the electronic keyboard musical instrument to give him key-touch similar to the unique key touch of the acoustic piano. The key-touch is depending upon the mechanism of the keys incorporated in the prior art electronic keyboard musical instrument, and is hardly changed. This is the second problem inherent in the prior art electronic keyboard musical instrument.

SUMMARY OF THE INVENTION

It is therefore an important object of the present invention to provide an analyzer, which is available for plural physical quantities.

It is also an important object of the present invention to provide a method, which is used in the analyzer.

It is another important object of the present invention to provide a musical instrument, which selectively offers different kinds of key-touch to sounds.

In accordance with one aspect of the present invention, there is provided an analyzer for a manipulator movable along a trajectory, and the analyzer comprises a position detector provided along the trajectory for detecting a current position of the manipulator, a velocity determiner connected to the position detector for determining a velocity of the manipulator between two positions spaced from each other on the trajectory and a resistance determiner connected to the position detector for estimating a resistance against a motion of the manipulator varied after reaching a predetermined position on the trajectory.

In accordance with another aspect of the present invention, there is provided a method for analyzing plural physical quantities of a manipulator movable along a trajectory, and the method comprises the steps of a) detecting a current position of said manipulator on said trajectory, b) repeating said step a) so as to see if said manipulator has passed a first section of said trajectory or a second section of said trajectory and c) selectively carrying out a determination of a velocity of said manipulator in said first section and an estimation of variation of a resistance against a motion of said manipulator in said second section.

In accordance with yet another aspect of the present invention, there is provided a musical instrument comprising plural manipulators movable along respective trajectories and manipulated by a player for changing at least one attribute of sounds, each of the trajectories having a first section and a second section, a resistance generator associated with the plural manipulators so as to generate a variable resistance against a motion of each manipulator manipulated by the player in the second section of the aforesaid each of the trajectories, a position detector provided along the trajectories so as to determine current positions of the plural manipulators and an electronic sound generating system including a velocity determiner connected to the position detector for determining a velocity of the aforesaid each of the manipulators in the first section, a resistance determiner connected to the position detector for estimating the variable resistance in the second section, a mode selector for selectively activating the velocity determiner and the resistance determiner and a sound generator connected to the position detector, the mode selector, the velocity determiner and the resistance determiner so as to generate the sounds with the aforesaid at least one attribute and modify another attribute of the sounds depending upon the velocity or a combination of the velocity and the variable resistance.

BRIEF DESCRIPTION OF THE DRAWINGS

The features and advantages of the analyzer, the method and the musical instrument will be more clearly understood from the following description taken in conjunction with the accompanying drawings in which.

DESCRIPTION OF THE PREFERRED EMBODIMENT

Mechanical Structure

Figure 1:
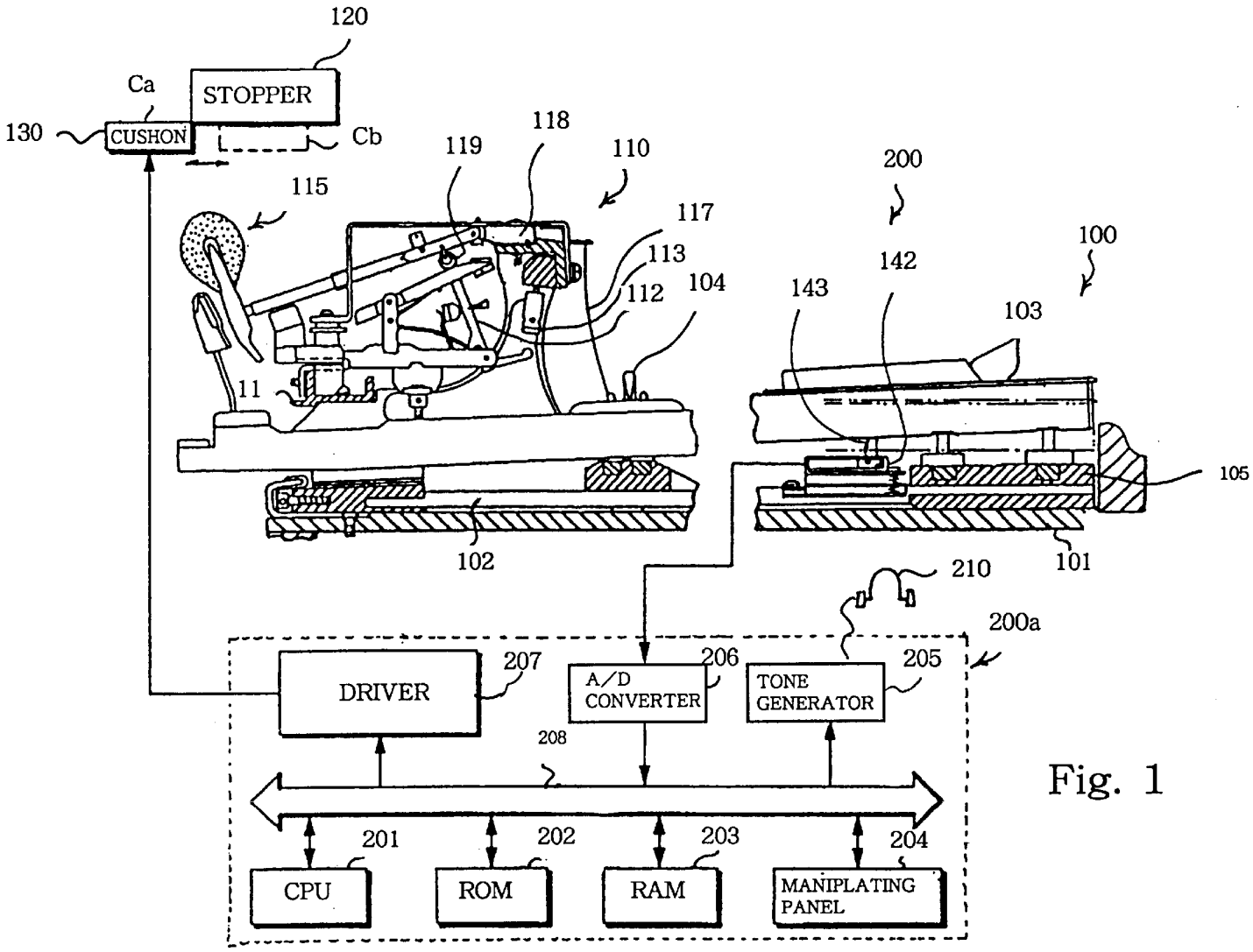
FIG. 1 is a schematic side view showing an electronic piano according to the present invention.

FIG. 1 shows an electronic piano embodying the present invention. Sensors according to the present invention are used in the electronic piano for detecting a key velocity and a resistance against a motion of a manipulator.

The electronic piano is fabricated on the basis of an acoustic piano. Namely, the electronic piano comprises an acoustic piano and an electronic sound generating system 200. In this instance, a grand piano is used as the acoustic piano. However, strings and damper mechanisms are deleted from the grand piano. An upright piano is available for the electronic piano.

The acoustic piano includes a keyboard 100. A key bed 101 forms a part of a piano housing, and a key frame 102 is placed on the key bed 101. Plural black keys 103 and white keys 103 are rotatably supported by the key frame 102, and are rotatable around balance pins 104, respectively. Eighty-eight black/white keys 103 are laid on the well-known pattern, and the keyboard 100 extends in a direction normal to the paper where the electronic piano is illustrated as FIG. 1. While a player does not exert any force on the black/white keys 103, the black/white keys 103 keep the front end portions spaced from a front rail 105, and are staying in rest positions, respectively. When the player depresses the front end portion of each black/white key 103, the front end portion is downwardly sunk, and reaches an end position. While the depressed black/white key 103 is traveling from the rest position toward the end position, the player feels the depressed black/white key 103 heavier at a certain position, and, thereafter, feels the load removed. It is possible to pull up the front end portions of the black/white keys 103, and the key positions over the rest positions are called as "open positions".

In the following description, the rest position and the end position are labeled with "Kr" and "Ke", respectively. The certain position is labeled with "Kx", and "Ko" is indicative of the open position.

The acoustic piano further includes hammer action mechanisms 110 and hammer assemblies 105. The hammer action mechanisms 110 are respectively linked with the black/white keys 103, and the hammer assemblies 105 are respectively driven for rotation by the associated hammer action mechanisms 110. The hammer action mechanisms 110 are supported by a whippen rail 116. The whippen rail 16 laterally extends over the rear end portions of the black/white keys 103, and are supported by action brackets 117. The action brackets 117 are laterally spaced from one another, and are mounted on the key bed 101. The hammer assemblies 105 are rotatably supported by a shank flange rail 118, which in turn is supported by the action brackets 117.

The hammer action mechanism 110 has a jack 112, and the hammer assembly 115 has a hammer roller 119. When the toe of the jack 112 is brought into contact with a regulating button 113, the jack 112 escapes from the hammer roller 119, and the hammer assembly 115 is driven for rotation around the shank flange rail 118 in the clockwise direction. The hammer action mechanism 110 is similar to a standard hammer action mechanism incorporated in an acoustic grand piano, which is known to a person skilled in the art. For this reason, no further description is incorporated hereinbelow.

The electronic piano further comprises a stopper 120, a cushion 130 and a limiter (not shown). The stopper 120 is provided over the hammer assemblies 115, and is stationary with respect to the key bed 101. The stopper 120 has the lower surface to be struck with the hammer assemblies 115, and the lower surface is adjusted to the position where sets of strings are stretched in a standard grand piano. The cushion 130 is slidable with respect to the stopper 120, and is changed between a shunt position and a blocking position. Real line Ca is indicative of the cushion 130 at the shunt position, and broken line Cb indicates the cushion 130 at the blocking position.

When the cushion 130 is changed to the shunt position, the cushion 130 is out of the trajectories of the hammer assemblies 115, and the hammer assemblies 115 are pressed against the cushion 130. On the other hand, when the cushion 130 is changed to the blocking position, the cushion 130 is positioned on the trajectories of the hammer assemblies 115, and the hammer assemblies 115 are pressed against the cushion 130. The cushion 130 defines the certain position Kx for each of the black/white keys 103. The limiter defines the end positions Ke of the black/white keys 103. The player can select one of two modes of operation. The first mode is "piano touch mode", and the second mode is "two-step touch mode". When the electronic piano is established in the piano touch mode, the electronic sound generating system 200 generates electronic sounds through the initial touch control, and the key velocity is determined for the electronic sound. The cushion 130 is staying at the shunt position Ca, and the hammer assemblies 115 reach the stopper 120.

On the other hand, when the electronic piano is established in the two-step touch mode, the electronic sound generating system 200 generates the electronic sounds through the after touch control, and a pressure is measured for the electronic sound. The cushion 130 is changed to the blocking position Cb. A player is assumed to depress a black/white key 103. The depressed black/white key 103 gives rise to a rotation of the associated hammer assembly 115, and the hammer assembly 115 is brought into collision with the cushion 130. When the black/white key 103 reaches the certain position Kx, the hammer assembly 115 is brought into collision with the cushion 130. The player further depresses the black/white key 103. Then, the hammer assembly 115 is strongly pressed against the cushion 130, and the cushion 130 increases the resistance against the key motion. The player feels the black/white key 103 heavier. The trajectory of each key 103 is divided into two sections. The first section is from the rest position to a position where the hammer assembly 115 is brought into collision with the cushion 130, and the second section is after the position. The electronic sound generating system 200 determines the key velocity in the first section and the pressure against the finger in the second section.

As described hereinbefore, the sets of strings are replaced with the stopper 120, and the hammers 115 at the rest positions are spaced from the stopper 120 by a distance equal to the distance between the hammers and the sets of strings.

When a player depresses a black/white key 103, he feels the resistance against the key motion due to the actuation of the associated hammer action mechanism 110. The jack 112 is brought into contact with the regulating button 113, and the jack 112 escapes from the hammer roller 119. Then, the player feels the resistance removed, and the escape is causative of the unique piano touch. When the black/white key 103 is slowly depressed, the black/white key 103 gives rise to the escape at several millimeters measured between the set of strings/stopper 120 and the hammer assembly 115. The position of the hammer assembly 115 at the escape is hereinbelow referred to as "proximity". The distance between the set of strings and the hammer assembly at the proximity is well known to a person skilled in the art as a tuning parameter of the acoustic piano. The cushion 130 has the thickness greater than the distance between the strings/stopper 120 and the hammer assembly 115 at the proximity, and, accordingly, the hammer 115 is brought into collision with the cushion before the escape.

While the electronic piano is operating in the two-step touch mode, the player feels the resistance due to the hammer action mechanism 110 until the collision with the cushion 130. The hammer assembly 115 is brought into collision with the cushion 130, and, thereafter, the resistance against the key motion is increased due to the resilient force of the cushion 130. If the player further depresses the black/white key 103, the hammer assembly 115 compresses the cushion 130. When the black/white key 103 reaches the end position Ke, the thickness of the compressed cushion 130 is greater than the distance at the proximity. Thus, the black/white keys 103 reach the end positions Ke before the escapes of the associated jacks 112, and make the electronic sound generating system 200 produce the electronic sounds through the after touch control.

Electronic System

The electronic sound generating system 200 includes an array of analog key sensors 142 mounted on the key bed 101, shutter plates 143 attached to the lower surfaces of the black/white keys 103 and a controller 200*a* connected to the analog key sensors 142. The analog key sensors 142 are combined with the shutter plates 143, respectively. The analog key sensor 142 is placed on the trajectory of the shutter plate 143, and produces an analog key position signal representative of a current key position. Namely, the analog key position signal varies the potential level depending upon the current position of the associated shutter plate 143, and the potential level of the analog key position signal represents the current key position. The controller 200*a* periodically checks the analog key sensors 142 to see whether or not the player changes the current key positions of the associated black/white keys 103. The analog key sensors 142 may be similar to the photo-sensor disclosed in Japanese Patent Publication of Unexamined Application No. 9-54584.

The controller 200*a* includes a central processing unit 201, a read only memory 202, a random access memory 203, a manipulating panel 204, a tone generator 205, an analog-to-digital converter 206, a driver 207 and a shared bus interconnecting the other components 201/202/203/204/205/206/207. The central processing unit 201, the read only memory 202 and the random access memory 203 are respectively abbreviated as "CPU", "ROM" and "RAM" in FIG. 1.

Computer programs and control parameters are stored in the read only memory 202. The computer programs will be described hereinlater in detail. The values of the analog key position signals are related to the current key positions as the control parameters. The central processing unit 201 sequentially fetches the programmed instruction codes, and executes them so as to achieve given jobs. The central processing unit 201 produces a set of digital music data codes representative of a performance on the keyboard 100 through the execution of the computer programs. Pieces of control data information are produced on the basis of the key velocity and the pressure against the key motion, and are stored in the digital music data codes. The random access memory 203 serves as a working memory, and various data, flags and variables are temporarily stored in the random access memory 203.

Figure 2:
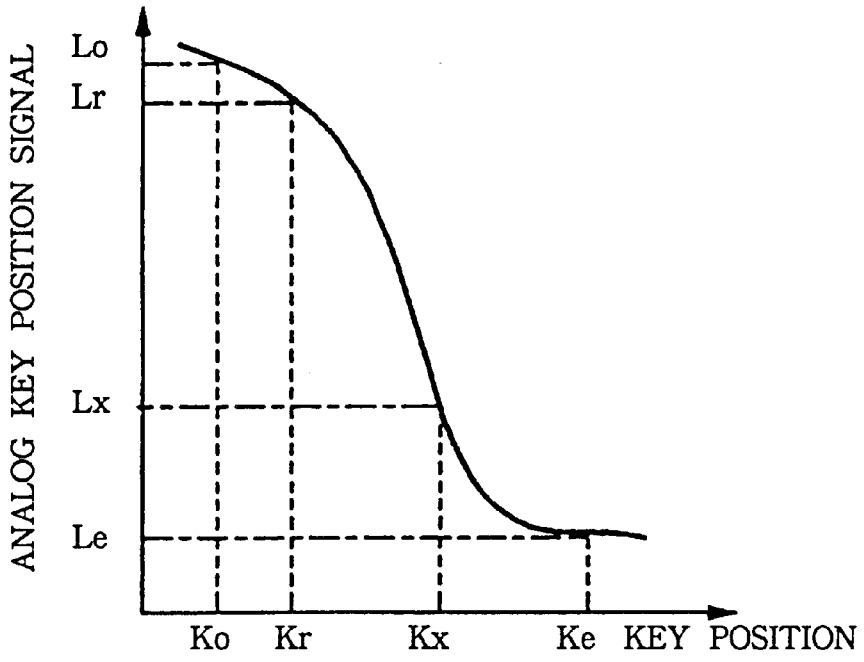
FIG. 2 is a graph showing a relation between an analog key position signal and a current key position.
Figure 3:
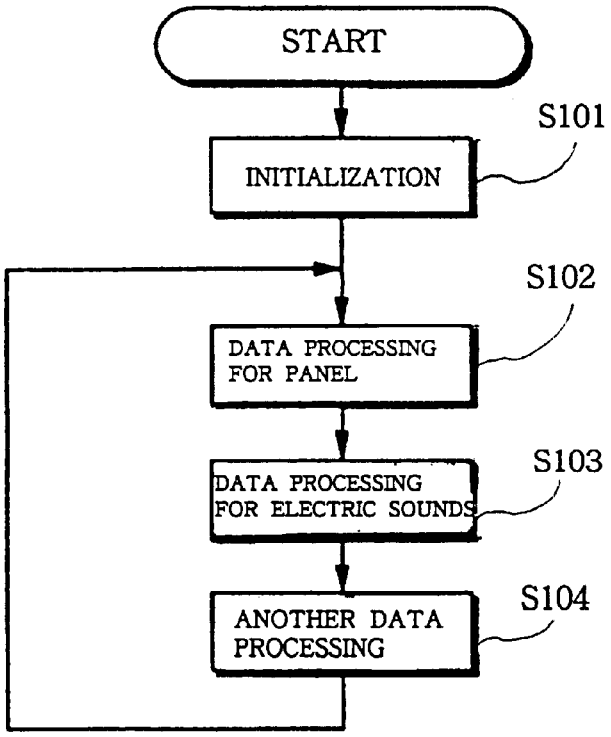
FIG. 3 is a flowchart showing a main routine program for the electronic piano.

FIG. 2 shows the relation between the analog key position signal and the current key position for one of the black/white keys 103. When the black/white key 103 is changed from the open position Ko through the rest position Kr, the certain position Kx to the end position Ke, the analog key position signal varies the potential level from Lo through Lr and Lx to Le. The relation is stored in the read only memory 202 as a kind of control parameters.

An example of the variables to be stored in the random access memory 203 is sets of thresholds Li and Lj, which are provided for the black/white keys 103, respectively. The first threshold Li is representative of a key position Ki closer to the rest position Kr than the key position Kj represented by the second threshold Lj. The first threshold Li and the second threshold Lj are determined on the basis of the value Lr of the key position signal. Namely, value Lr for each black/white key 103 is multiplied by two coefficients ri/rj, and the products are used as the first threshold Li and the second threshold Lj, respectively. The coefficients ri/rj relates to key positions appropriate to discriminate the key motion, and are experimentally determined for each of the black/white keys 103. The coefficients ri/rj are stored in the read only memory 202 as another kind of control parameters. The first threshold Li and the second threshold Lj are used for calculation of the key velocity.

Various switches are provided on the manipulating panel 204. One of the switches is used for selection between the piano touch mode and the two-step touch mode. The central processing unit 201 also periodically checks the switches to see whether or not the player manipulates any switch. The digital music data codes are supplied to the tone generator 205. The tone generator 205 generates an audio signal from the digital music data codes, and supplies the audio signal to a headphone 210, by way of example. The headphone 210 generates electronic sounds corresponding to the acoustic sounds to be produced by depressing the black/white keys 103 from the audio signal.

The analog-to-digital converter 206 is connected to the analog key sensors 142, and converts the analog key position signals to digital key position signals. The central processing unit 201 periodically fetches the digital key position signals. As described hereinbefore, the relation between the key position signal and the current key position is stored in the read only memory 202 for each of the black/white keys 103. When the central processing unit 201 fetches a digital key position signal associated with one of the black/white keys 103, the central processing unit 201 compares the binary value corresponding to the potential level with the values on the axis of ordinates, and determines the current key position for the black/white key 103. The central processing unit 201 calculates the key velocity on the basis of two current key positions and the lapse of time therebetween.

The driver 207 is connected to the cushion 130, and changes the cushion between the shunt position Ca and the blocking position Cb. If the switch assigned to the selection of mode is manipulated, the central processing unit 201 instructs the driver 201 to change the cushion 130 to the position to be requested. In this instance, an electric motor and a suitable converter from rotation to reciprocal motion are incorporated in the driver 207. The converter is connected to the cushion 130. The rotation of the electric motor is converted to a reciprocal motion, and changes the cushion 130 between the shunt position Ca and the blocking position Cb.

Upon collision with the cushion 130, the hammer assembly 115 compresses the cushion 130. This means that the resistance against the key position is increased together with the distance from the certain position Kx. For this reason, the central processing unit 201 decides the distance from the certain position Kx to be the increment of the resistance.

Computer Programs

Description is hereinbelow made on the computer programs with reference to FIGS. 3 to 7. In the description, a player is assumed to depress one of the black/white keys 103. However, the black/white keys 103 are selectively depressed in a performance, and the central processing unit repeats the data processing similar to that described hereinbelow.

First, a main routine program is described. FIG. 1 illustrates a program sequence of the main routine program. When the controller 200a is powered, the central processing unit 201 initializes the other components such as, for example, the random access memory 203 as by step S101. Flags and variables, which will be hereinlater detailed, are set to default values, respectively. An internal timer is reset to zero, and, thereafter, starts to increment stored value representative of the lapse of time. The thresholds Li/Lj are calculated on the basis of the values Lr and the coefficients ri/rj, and are stored in the random access memory 203.

Upon completion of step S101, the central processing unit 201 proceeds to step S102 for a data processing for the manipulating panel 204. The central processing unit 201 checks the manipulating panel 204 to see whether or not the player manipulates the switches. If any switch is not changed, the central processing unit 201 proceeds to the next step S103. On the other hand, when any one of the switches has been manipulated, the answer is given affirmative, and the central processing unit 201 interprets the instruction given through the manipulated switch, and changes a flag/variable associated with the manipulated switch. If the switch assigned to the selection of the mode is manipulated, the central processing unit 201 changes a flag MODE between "1" and "2". The flag MODE of "1" is indicative of the piano touch mode, and the flag MODE of "2" is indicative of the two-step touch mode.

Subsequently, the central processing unit 201 proceeds to step S103, and carries out a data processing for generating electronic sounds. The data processing for generating the electronic sounds will be hereinlater described in detail.

When the central processing unit 201 returns from the sub-routine for either mode of operation, the central processing unit 201 proceeds to step S104, and carries out another data processing. Then, the central processing unit 201 returns to step S102, and reiterates the loop consisting of steps S102 to S104 until power-off.

Figure 4:
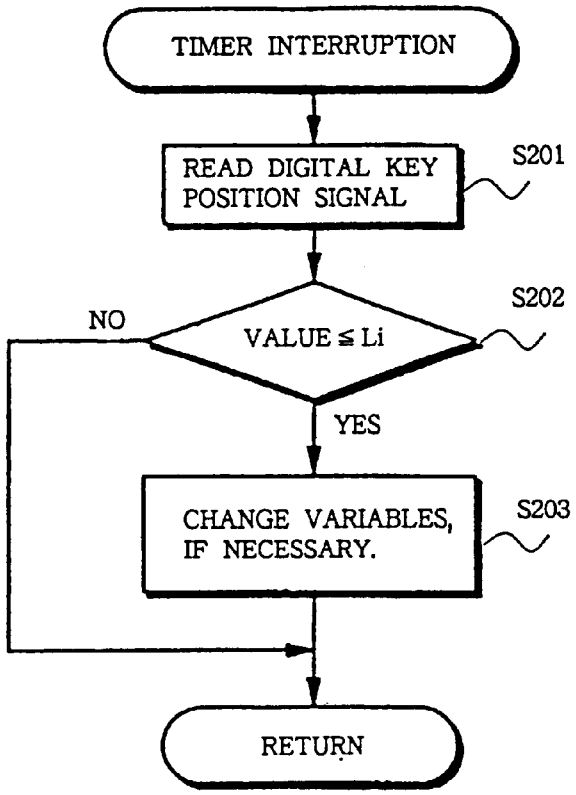
FIG. 4 is a flowchart showing a sub-routine program for a timer interruption.

FIG. 4 illustrates a sub-routine program for a timer interruption. The timer interruption takes place at predetermined intervals, and the central processing unit 201 is branched to the sub-routine program at every timer interruption. The sub-routine program contains steps S201, S202 and S203, and the central processing unit 201 repeats steps S201/S202/S203 for all the black/white keys 103.

The flag and the variables used in the generation of electronic sounds are firstly described. The flag MODE has been described hereinbefore. Variable Vel is representative of the key velocity of the black/white key 103. Variable Ti and variable Tj represent a first time and a second time when the value of the key position signal reaches the first threshold Li and the second threshold Lj, respectively. Variable Tx represents a time when the black/white key 103 reaches the certain position Kx, and variable Tr represents a time when the black/white key 103 returns to the rest position Kr. These variables Vel, Ti, Tj, Tx and Tr are stored in the random access memory 203 for each of the black/white keys 103.

Upon entry into the sub-routine program for the timer interruption, the central processing unit 201 reads the value of the digital key position signal representative of the current key position of the black/white key 103 as by step S201.

Subsequently, the central processing unit 201 compares the value of the digital key position signal with the first threshold Li to see whether or not the player depresses the black/white key 103. If the value of the digital key position signal is greater than the first threshold Li, the central processing unit 201 decides that the black/white key 103 has not been depressed, yet, and returns to the main routine program without execution of step S203. On the other hand, if the value is equal to or less than the first threshold Li, the central processing unit 201 decides that the player has already depressed the black/white key 103, and proceeds to step S203.

The default values of the variables Vel, Ti, Tj, Tx and Tr are zero, and these variables Vel/Ti/Tj/Tx/Tr were set to zero in the initialization (see step S101). The central processing unit 201 changes the variables Ti/Tj/Tx/Tr to appropriate values in step S203, if necessary. Namely, the digital key position signal is compared with the thresholds Li/Lj and the values Lx/Lr so see whether or not the depressed black/white key 103 reaches the key position Ki, Kj, Lx or Kr. If the answer is given negative, the central processing unit 201 returns to the main routine program. However, if the answer is affirmative, the central processing unit 201 changes the corresponding variable to the stored value of the internal timer. Thereafter, the central processing unit 201 returns to the main routine program.

Figure 6:
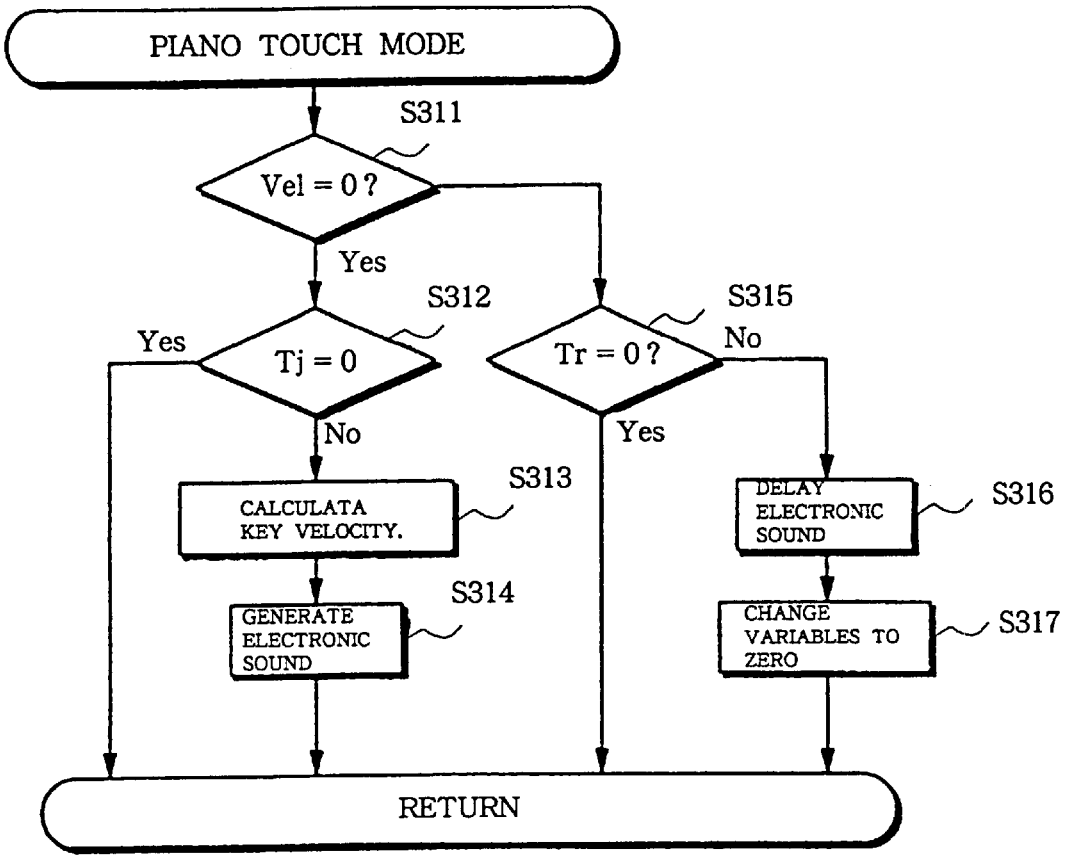
FIG. 6 is a flowchart showing a sub-routine program for a piano touch mode.
Figure 7:
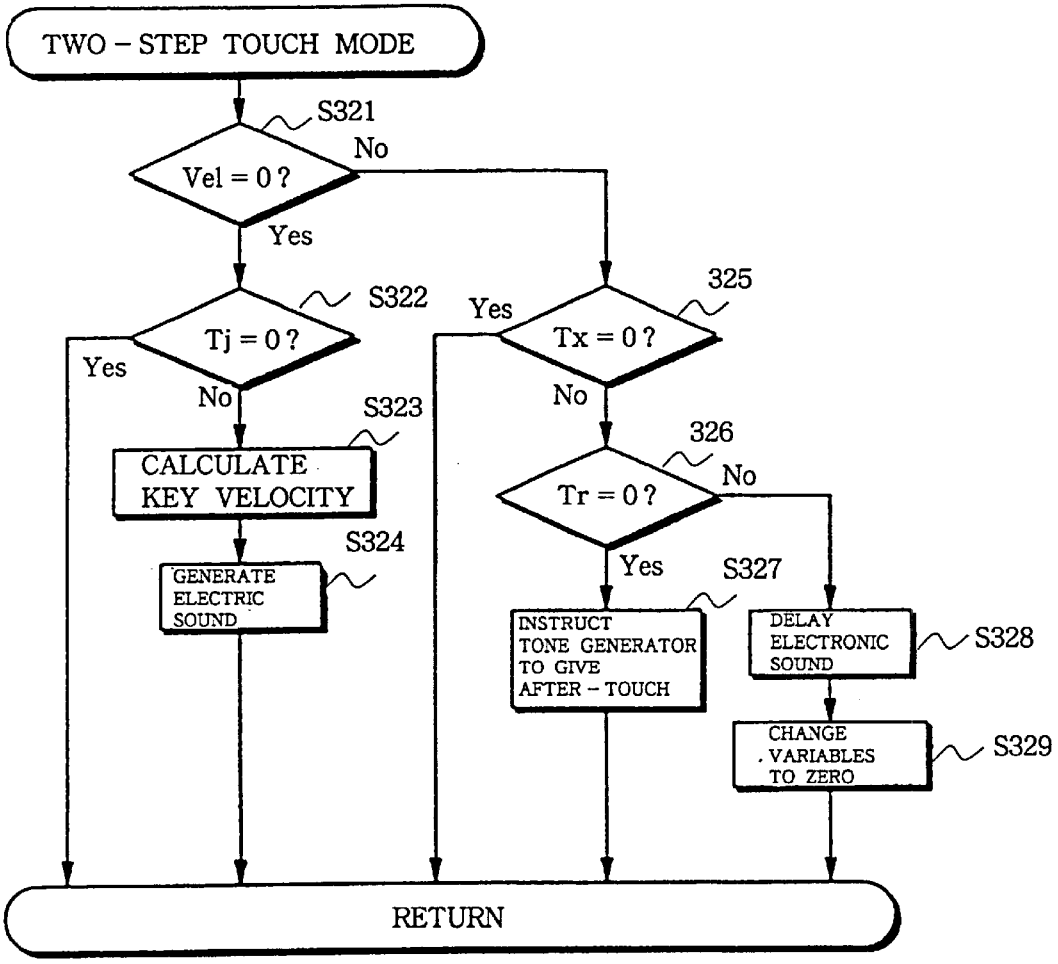
FIG. 7 is a flowchart showing a sub-routine program for a two-step touch mode.

The data processing for the electronic sounds at step S103 is achieved through a sub-routine program for selecting the operation mode (see FIG. 5), a sub-routine program for the piano touch mode (see FIG. 6) and a sub-routine program for the two-step touch mode (see FIG. 7). The central processing unit 201 executes the sub-routine program for selecting the operation mode, and, thereafter, is branched to one of the remaining sub-routine programs.

When the central processing unit 201 is branched to the sub-routine program for selecting the operation mode, the central processing unit 201 reads the flag MODE, and checks the random access memory 203 to see whether the flag MODE has value "1" or "2" as by step S301. If the flag MODE has value "1", the central processing unit 201 is branched to the sub-routine program for the piano touch mode at step 310. On the other hand, if the flag MODE has value "2", the central processing unit 201 is branched to the sub-routine program for the two-step touch mode at step 320. Upon completion of the sub-routine program 310 or 320, the central processing unit 201 returns to the main routine program.

Assuming now that the flag MODE has been set to "1", the central processing unit 201 is branched to the sub-routine program for the piano touch mode shown in FIG. 6. Although the central processing unit 201 repeats the sub-routine program for the black/white keys 103 accompanied with the flags MODE of "1", description is made on one of the black/white keys 103. The central processing unit 201 firstly checks the variable Vel to see whether or not the key velocity has been already calculated. There are four possibilities of the key position.

The first possibility is that the depressed black/white key 103 is traveling between the key position Ki and the key position Kj. In this situation, the key velocity has not been calculated, and the answer at step S311 is given negative. Then, the central processing unit 201 proceeds to step S312, and checks the random access memory 203 to see whether or not the variable Tj is equal to zero as by step S312. The answer at step S312 is given affirmative in the first possibility, and the central processing unit 201 returns to the main routine program.

The second possibility is that the depressed black/white key 103 has just passed the key position Kj after the previous data acquisition. In this situation, the key velocity has not been calculated, yet, and the answer at step S311 is given affirmative. The central processing unit 201 proceeds to step S312, and checks the random access memory 203 to see whether or not the variable Tj is zero. When the depressed black/white key 103 passed the key position Kj, the variable was changed to the stored value of the internal timer at step S203, and the answer at step S312 is given negative. The central processing unit 201 calculates the key velocity for the depressed black/white key 103 as by step S313, and changes the variable Vel to the calculation result. The key velocity VEL is given as follows.

$$VEL=\{(Ki-Kj)/\mathrm{Kr}\}/(Tj-Ti)$$

The reason why the difference between the key positions Ki and Kj is divided by the rest position Kr is a normalization. Thus, the key velocity is equal to (normalized distance)/(lapse of time between the key positions Ki and Kj). The central processing unit 201 produces a music data code containing pieces of music data information representative of a key code assigned to the depressed black/white key 103 and the velocity VEL, and instructs the tone generator 205 to produce the audio signal from the music data code as by step S314. The tone generator 205 produce s the audio signal from the music data code, and the headphone 210 generates the electronic sound corresponding to the acoustic sound to be generated in an acoustic grand piano. Thereafter, the central processing unit 201 returns to the main routine program.

The third possibility is that the black/white key 103 is on the way to the rest position Kr. The black/white key 103 has been already released, and the headphone 210 is generating the electronic sound. This means that the key velocity VEL was calculated. For this reason, the answer at step S311 is given negative, and the central processing unit 201 proceeds to step S315. The central processing unit 201 checks the random access memory 203 to see whether or not the variable Tr is zero. The released black/white key 103 has not reached the rest position Kr in the third possibility, and the answer at step S315 is given affirmative. Then, the central processing unit 201 returns to the main routine program, and the headphone 210 continues to generate the electronic sound.

The fourth possibility is that the released black/white key 103 has already reached the rest position Kr. In this situation, both answers at steps S311 and S315 are given negative. The central processing unit 201 produces a music data code representative of the key code assigned to the black/white key 103, and instructs the tone generator 205 to decay the electronic sound as by step S316. The central processing unit 201 changes the variables Ti, Tj, Tr and Vel to zero as by step S317, and the electronic sound generating system 200 gets ready for generating the electronic sound, again. The central processing unit 201 returns to the main routine program. Thus, the electronic sound is controlled on the basis of the key velocity, and the hammer action mechanism 110 gives the unique piano touch to the player. For this reason, a piano-like tone color may be imparted to the electronic sounds in the piano touch mode.

The flag MODE is assumed to be "2". The central processing unit 201 is branched to the sub-routine program for the two-step touch mode shown in FIG. 7. The central processing unit 201 also repeats the sub-routine program for the black/white keys 103 accompanied with the flags MODE of "1", description is made on one of the black/white keys 103. The central processing unit 201 firstly checks the variable Vel to see whether or not the key velocity has been already calculated as by step S321. There are five possibilities of the key position.

The first possibility is that the depressed black/white key 103 is traveling between the key position Ki and the key position Kj. In this situation, the key velocity has not been calculated, and the answer at step S321 is given negative. Then, the central processing unit 201 proceeds to step S322, and checks the random access memory 203 to see whether or not the variable Tj is equal to zero as by step S322. The answer at step S322 is given affirmative in the first possibility, and the central processing unit 201 returns to the main routine program.

The second possibility is that the depressed black/white key 103 has just passed the key position Kj after the previous data acquisition. In this situation, the key velocity has not been calculated, yet, and the answer at step S321 is given affirmative. The central processing unit 201 proceeds to step S322, and checks the random access memory 203 to see whether or not the variable Tj is zero. When the depressed black/white key 103 passed the key position Kj, the variable was changed to the stored value of the internal timer at step S203, and the answer at step S322 is given negative. The central processing unit 201 calculates the key velocity for the depressed black/white key 103 as by step S323, and changes the variable Vel to the calculation result. Subsequently, the central processing unit 201 produces a music data code containing pieces of music data information representative of a key code assigned to the depressed black/white key 103 and the velocity VEL, and instructs the tone generator 205 to produce the audio signal from the music data code as by step S324. The tone generator 205 produces the audio signal from the music data code, and the headphone 210 generates the electronic sound corresponding to the acoustic sound to be generated in an acoustic grand piano. Thereafter, the central processing unit 201 returns to the main routine program.

The third possibility is that the black/white key 103 is on the way toward the rest position Kr. Although the black/white key 103 was released, the black/white key 103 has not reached the key position Kx, yet. The headphone 210 is generating the electronic sound. This means that the key velocity VEL was calculated in a previous loop. For this reason, the answer at step S321 is given negative, and the central processing unit 201 proceeds to step S325. The central processing unit 201 checks the random access memory 203 to see whether or not the variable Tx is zero. The answer at step S325 is given affirmative in the third possibility, and the central processing unit 201 returns to the main routine program.

The fourth possibility is that the black/white key 103 has passed the key position Kx but not reached the rest position Kr, yet. Both answers at steps S321/325 are given negative, and the central processing unit 201 checks the random access memory 203 to see whether or not the variable Tr is zero as by step S326. The answer at step S326 is given affirmative in the fourth possibility. The central processing unit 201 instructs the tone generator 205 to give an effect called as "after-touch" to the electronic sound as by step S327. The tone generator 205 modifies the audio signal so as to impart the effect to the electronic sound. The central processing unit 201 returns to the main routine program.

The fifth possibility is that the black/white key 103 has already reached the rest position Kr. All the answers at steps S321/S325/S326 are given negative. The central processing unit 201 produces a music data code representative of the key code assigned to the black/white key 103, and instructs the tone generator 205 to decay the electronic sound as by step S328. The central processing unit 201 changes the variables Ti, Tj, Tx, Tr and Vel to zero as by step S329, and the electronic sound generating system 200 gets ready for generating the electronic sound, again. The central processing unit 201 returns to the main routine program. The electronic sound generating system 200 can control the after-touch in the two-step touch control mode. For this reason, the electronic sound may have a tone color like that of a wind instrument or a stringed instrument.

As will be understood from the foregoing description, the central processing unit 201 is selectively branched to the sub-routine programs shown in FIGS. 6 and 7 depending upon the value of the flag MODE, and differently generates the electronic sound.

Figure 8:
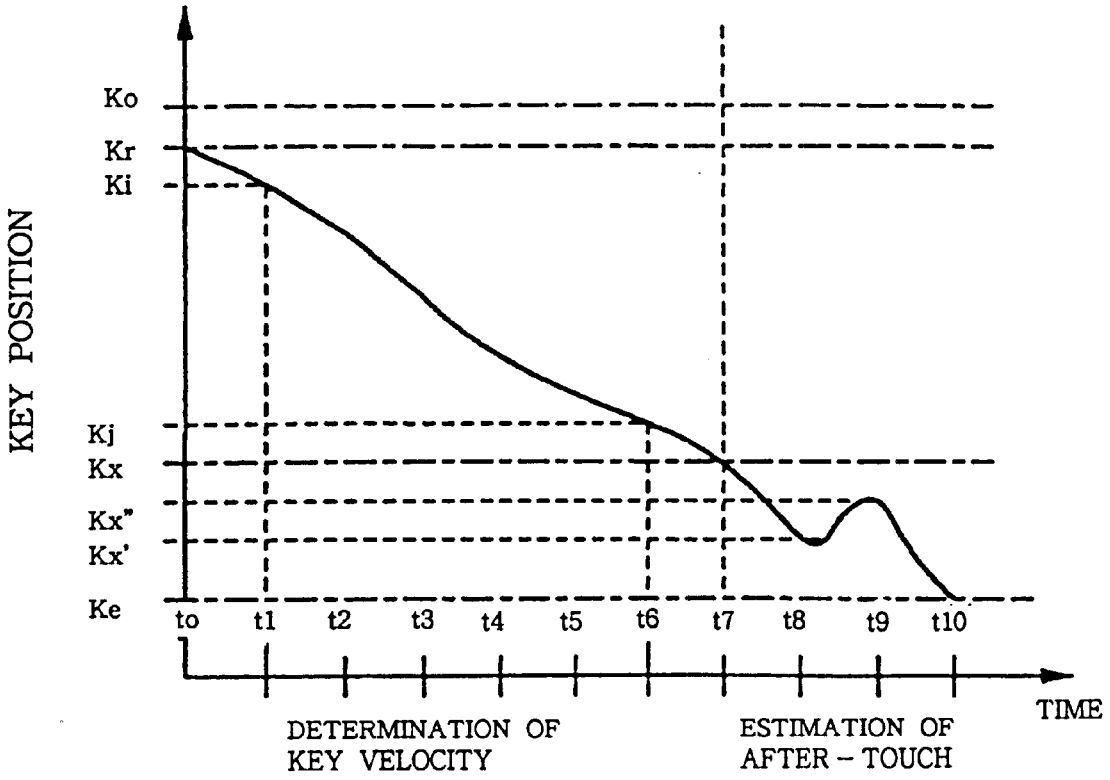
FIG. 8 is a graph showing a trajectory of a black/white key depressed in a performance.

FIG. 8 illustrates a trajectory of a black/white key 103. The black/white key 103 starts the rest position at time t0, and passes the key positions Ki and Kj at time t1 and time t6. The variable Tj is changed to t6, which is not zero. Then, the central processing unit 201 calculates the key velocity on the basis of the values of the variables Ki/Kj, Ti=t1 and Tj=t6, and produces the music data code. The tone generator 205 produces the audio signal from the music data code, and the headphone 210 generates the electronic sound.

The black/white key 103 is further sunk, and reaches the key position Kx at time t7. The hammer assembly 115 is brought into collision with the cushion 130. Although the player depresses the black/white key 103, the black/white key 103 is slightly pushed back from the key position Kx' at time t8 to the key position Kx" at time t9. The hammer assembly 115 compresses the cushion 130, again, and the black/white key 103 reaches the end position Ke at time t10. Thus, the hammer assembly 115 compresses the cushion 130 between the key position Kx to the end position Ke, and the cushion 130 varies the resilient force from time t7 to time t10. This means that the resistance against the key motion is also varied from time t7 to time t10. The key sensor 142 varies the potential level of the analog key position signal from time t7 to time t10, and the central processing unit 201 estimates the variation of the resistance on the basis of a series of values of the digital key position signal at the key positions Kx' at time t8, Kx" at time t9 and Ke at time t10. The central processing unit 201 determines the after-touch on the basis of the variation of resistance. Thus, the key sensor 142 is available for the determination of key velocity in the first section between the key positions Ki and Kj and the estimation of after-touch in the second section between the key positions Kx and Ke. The second section is closer to the strings/stopper 120 than the first section. The first section is assigned to the determination of key velocity or the initial touch. On the other hand, the hammer assembly 115 compresses the cushion 130 in the second section, and the key sensor 142 detects the increased force exerted on the black/white key 103. This results in the estimation of after-touch. The sound control on the basis of the key velocity and the variation of resistance may have influence on a pitch, vibrato, volume, expression and brilliant.

In the above-described embodiment, the electronic piano has two modes of operation, i.e., the piano touch mode and the two-step touch mode. Only the key velocity is calculated on the basis of the key positions Ki and Kj at both ends of the first section in the piano touch mode. On the other hand, the electronic sound generating system 200 determines the initial touch in the first section and the after-touch in the second section. Thus, the electronic piano according to the present invention has various control sequences, and offers them to a player.

The analog key sensors 142 and the shutter plates 143 are shared between the determination of key velocity and the estimation in variation of resistance. Only the computer program is different between the determination of key velocity and the estimation in variation of resistance. This results in reduction of production cost.

In the above-described embodiment, the analog key sensors 142, the shutter plates 143 and the analog-to-digital converter 206 as a whole constitute a position detector. The central processing unit 201, the control parameters defining the relation shown in FIG. 2, the variables Ti/Tj and the thresholds Li/Lj, the sub-routine program shown in FIG. 4 and steps S311 to S313/S321 to S323 as a whole constitute a velocity determiner. The central processing unit 201, the control parameters defining the relation shown in FIG. 2, the control parameters for the after-touch, the variables Ti/Tj/Tx/Tr/Vel, the sub-routine program shown in FIG. 4 and steps S321/S325 to 327 as a whole constitute a resistance determiner.

Figure 5:
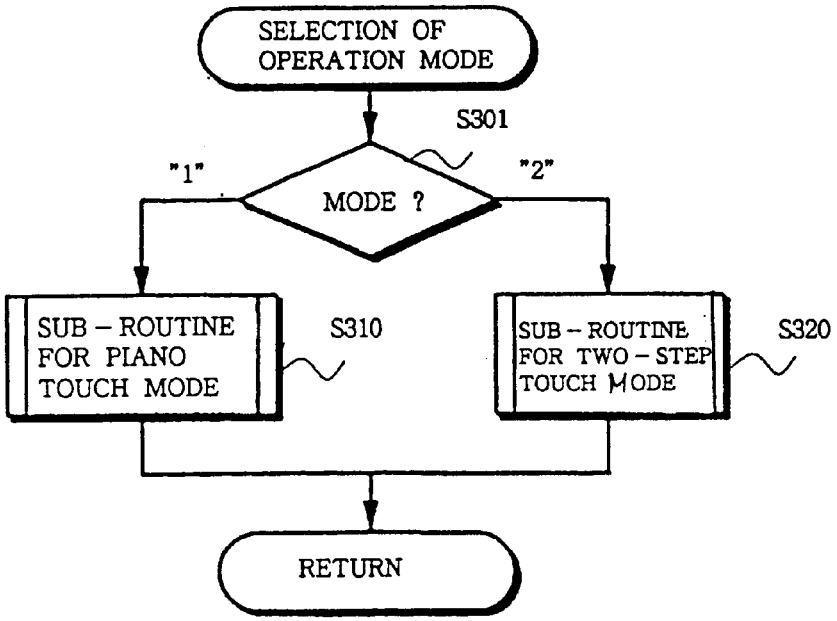
FIG. 5 is a flowchart showing a sub-routine program for selection of an operating mode.

The cushion 130 serves as a resistance generator, and the switch assigned for the operation mode, the central processing unit 201, the driver 207, the flag MODE and the sub-routine program shown in FIG. 5 as a whole constitute a selector. The central processing unit 201, the tone generator 205, the headphone 210 and steps S314/S316/S324/S327/S328 as a whole constitute a sound generator.

Although particular embodiments of the present invention have been shown and described, it will be apparent to those skilled in the art that various changes and modifications may be made without departing from the spirit and scope of the present invention.

For example, the minimum thickness of the compressed cushion 130 may be less than the distance at the proximity. In this instance, the cushion 130 allows the jack 112 to escape from the hammer roller 119, and the hammer action mechanism 110 is prevented from the breakage.

The electronic keyboard musical instrument may be fabricated on the basis of an organ or another kind of keyboard musical instrument. The hammer assemblies may be deleted from the electronic piano according to the present invention. The present invention may be applied to an array of foot pedals.

The key velocity may be calculated on the basis of data at four points as taught by Japanese Patent Publication of Unexamined Application No. 9-54584. The electronic sound may be decayed at an appropriate position between the key positions Kx and Kr such as, for example, the key position Ki (see FIG. 8). The first section, the key position for starting an electronic sound and/or the key position for decaying the electronic sound may be different between the piano touch mode and the two-step touch mode.

The cushion 130 may be provided under the black/white keys 103. The cushion may be replaced with other kind of resilient/elastic member. The cushion may be varied depending upon the distance between the hammer assemblies 115 and the stopper 120.

The driver 207 may be implemented by a suitable link mechanism manipulated by a player. The cushion 130 may be automatically changed between the shunt position Ca and the blocking position Cb depending upon a tone color selected by the player.

A part of the cushion may be changed to the blocking position Cb. In this instance, the associated part of the keyboard 100 is available for electronic sounds like the acoustic tones generated by a wind/stringed instrument, and the remaining part of the keyboard is used for generation of electronic sounds like the piano tones. Thus, the electronic piano is used for an ensemble.

The electronic sound generating system 200 may control the after-touch on the basis of the key positions between the key position Kx and the rest position Kr.

The musical instrument according to the present invention may be similar to a silent piano such as, for example, disclosed in U.S. Pat. No. 5,541,353. The present invention may be applied to an automatic player piano or a silent automatic player piano, in which a hammer stopper is provided inside of the automatic player piano.

What is claimed is:

1. A musical instrument comprising plural manipulators movable along respective trajectories and manipulated by a player for changing at least one attribute of sounds, each of said trajectories having a first section and a second section, a resistance generator associated with said plural manipulators so as to generate a variable resistance against a motion of each manipulator manipulated by said player in said second section of said each of said trajectories, a position detector provided along said trajectories so as to determine current positions of said plural manipulators, and an electronic sound generating system including a velocity determiner connected to said position detector for determining a velocity of said each of said manipulators in said first section, a resistance determiner connected to said position detector for estimating said variable resistance in said second section, a mode selector for selectively activating said velocity determiner and said resistance determiner and a sound generator connected to, said position detector, said mode selector, said velocity determiner and said resistance determiner so as to generate said sounds with at least one attribute and modify another attribute of said sounds depending upon said velocity or a combination of said velocity and said variable resistance.

2. The musical instrument as set forth in claim 1, in which said plural manipulators form in combination a keyboard.

3. The musical instrument as set forth in claim 2, further comprising plural action mechanisms respectively associated with said manipulators and selectively actuated by said each of said plural manipulators, and plural hammer assemblies respectively associated with said plural action mechanisms and selectively driven for rotation by the action mechanism actuated by said each of said plural manipulators.

4. The musical instrument as set forth in claim 1, in which said velocity is used in an initial touch control for generating said sounds, and said variable resistance is used in an after touch control for generating said sounds.

5. The musical instrument as set forth in claim 4, in which said plural manipulators are used for specifying a pitch of said sounds.

6. The musical instrument as set forth in claim 5, in which said plural manipulators form in combination a keyboard.

7. The musical instrument as set forth in claim 1, in which said at least one attribute is a pitch, and said another attribute is a tone color.

* * * * *